United States Patent [19]

Alexander et al.

[11] Patent Number: 4,749,502

[45] Date of Patent: Jun. 7, 1988

[54] GREASE COMPOSITION

[75] Inventors: A. Gordon Alexander; Donald W. Murray, both of Sarnia, Canada

[73] Assignee: Exxon Research and Engineering Company, Florham Park, N.J.

[21] Appl. No.: 885,140

[22] Filed: Jul. 14, 1986

[51] Int. Cl.[4] ..... C10M 117/02; C10M 107/10

[52] U.S. Cl. ..... 252/35; 252/39; 252/41; 252/56 R; 252/56 S

[58] Field of Search ..... 252/35, 39

[56] References Cited

U.S. PATENT DOCUMENTS

| | | | |
|---|---|---|---|
| 3,114,708 | 12/1963 | Morway et al. | 252/41 |
| 3,813,338 | 5/1974 | Coppock et al. | 252/42.1 |
| 3,939,083 | 2/1976 | Coppock et al. | 252/35 |
| 4,075,112 | 2/1978 | Van Doorne | 252/35 |
| 4,075,113 | 2/1978 | Van Doorne | 252/35 |

OTHER PUBLICATIONS

*Lubrication Fundamentals*, by J. George Wills, Marcel Dekker, Inc., New York, (1980), pp. 77–81.

*Primary Examiner*—William R. Dixon, Jr.

*Assistant Examiner*—Ellen McAvoy

*Attorney, Agent, or Firm*—Joseph J. Dvorak; John W. Ditsler

[57] ABSTRACT

The present invention is directed at a grease composition comprising:

A. an oil component having a major amount of a synthetic fluid having a viscosity of at least 50 cSt at 40° C. and a minor amount of a mineral oil having a pour point below −20° C.; and B. a thickener.

The oil component of the grease composition preferably comprises between about 30 and 90 wt. % synthetic oil, more preferably between about 40 and about 80 wt. % synthetic oil and from 70 to 10 wt. % and preferably 60 to 20 wt. % mineral oil. The viscosity of the synthetic oil preferably is at least 50 cSt, more preferably at least 100 cSt at 40° C. The synthetic oil preferably is selected from polyolefins, esters, polyesters, high VI isoparaffins, and mixtures thereof, with polyalphaolefins being particularly preferred. The polyalphaolefins preferably comprise $C_8$ and $C_{12}$ monoalphaolefin building blocks.

16 Claims, No Drawings

GREASE COMPOSITION

BACKGROUND OF THE INVENTION

The present invention is directed at a grease having desirable properties over wide temperature ranges.

Adequate lubrication of outdoor equipment, such as heavy production, construction, or mining equipment, may be hampered for a variety of reasons. The bearings and gears of such equipment frequently must operate under high, or shock, load conditions, at slow speeds, and in the presence of sand or other abrasive materials. Greases used under such conditions must contain oils of relatively high viscosity at normal operating temperatures to prevent damage to the moving parts because the thickness of the protective lubricant film increases as oil viscosity and sliding speed increase, and decreases directionally with applied load. Clearly, the lubricating film thickness needs to be greater than the diameter of abrasive particles if adequate protection to bearing and gear surfaces is to be provided. Furthermore, greases used in such dusty environments need to resist slumping at high ambient summer temperatures in order to maintain adequate sealing capabilities around the shafts of bearings and gears in order to prevent the ingress of dirt and abrasive materials. Thus, good performance greases for these applications need to have a moderately firm consistency, as well as a relatively high oil viscosity for summer operating conditions.

Automatic lubricating systems used in such heavy equipment frequently involve the use of long, relatively small diameter tubes to deliver the grease from a central supply location to the bearing or gear to be lubricated. While this normally presents no problem at ambient summer temperatures, ability to deliver the grease through these lines to the lubricated parts at winter ambient temperatures is often the limiting factor in grease selection. The National Lubricating Grease Institute has developed a series of nomographs by which dispensibility can be calculated from a number of factors which include tube length, tube diameter, pumping pressure, and grease apparent viscosity. It is well known in the art that grease apparent viscosity is a function primarily of base oil viscosity and grease consistency, at the dispensing temperature. Hence, in sub-arctic regions where ambient temperatures may vary from as low as −40° C. in winter to as high as 35° C. in summer, conflicting demands are placed on grease properties. In winter a low base oil viscosity and soft consistency is preferred for good dispensibility, while, in summer, relatively high viscosity and firm consistency is preferred to provide adequate lubrication and sealing against the ingress of dirt and abrasive materials.

U.S. Pat. No. 3,813,338 discloses a lubricant for use in textile machines comprising a naphthenic base oil, 0.3–6 wt.% polyolefin as a tackiness agent and 0.1–1.5 wt.% lithium soap.

U.S. Pat. No. 4,075,112 and U.S. Pat. No. 4,075,113 disclose grease compositions comprising 2–15 wt.% aluminum soap, 25 to 97% of a hydrogenated or non-hydrogenated polymer of a monoolefinic hydrocarbon having 4 carbon atoms and a mean molecular weight of between 300 and 2500, and 0–60 wt.% of a lubricating oil, which preferably is a mineral oil.

Japanese Patent Publication No. J5-9,109,595 discloses a lithium soap which may include a refined base stock derived from naphthenic, paraffinic and mixed base crudes. Synthetic lubricating oils also are disclosed as being useful. These synthetic oils include polymers and copolymers of alpha olefins.

Japanese Patent Publications J5-9,142,291-3 disclose lithium-containing lubricants comprising an aliphatic hydrocarbon oil.

Japanese Patent Publication No. J5-8,122,996 discloses a grease composition having lithium thickener and a base oil comprising substantially a $C_{19}$-$C_{30}$ naphthenic hydrocarbon.

U.S. Pat. No. 3,112,270 discloses a grease comprising a mineral oil, ethylene polymer and a soap thickener.

U.S. Pat. No. 3,114,708 discloses the manufacture of a dry grease blend comprising 20 to 75 weight percent polyolefin.

U.S. Pat. No. 3,813,338 discloses a high retention thickened oil lubricant for textile machinery comprising a naphthenic base oil, a polyolefin and a lithium thickener.

U.S. Pat. No. 3,539,512 discloses the combination of a base oil and a polyolefin thickener to produce a grease having a low tendency to bleed.

U.S. Pat. No. 3,541,011 discloses a gel lubricant comprising a mineral oil and polyethylene thickener.

U.S. Pat. No. 4,406,800 discloses a grease useful over a wide temperature range comprising a polyalphaolefin base fluid and a thickener.

It would be advantageous to provide a grease having acceptable dispensing and lubricating properties over a wide temperature range.

It also would be desirable to provide a grease having a high oil viscosity and relatively firm consistency in warm weather and a relatively soft consistency and relatively low apparent viscosity for pumping in cold weather.

It also would be desirable to provide a grease which is relatively inexpensive to manufacture, is shear stable, resists slumping, and has good extreme pressure and anti-wear properties.

SUMMARY OF THE INVENTION

The present invention is directed at a grease composition comprising:

A. an oil component having a major amount of a synthetic fluid having a viscosity of at least 50 cSt at 40° C. and a minor amount of a mineral oil having a pour point below −20° C.; and B. a thickener.

The oil component of the grease composition preferably comprises between about 30 and 90 wt.% synthetic oil, more preferably between about 40 and about 80 wt.% synthetic oil and from 70 to 10 wt.% and preferably 60 to 20 wt.% mineral oil. The viscosity of the synthetic oil preferably is at least 50 cSt, more preferably at least 100 cSt at 40° C. The synthetic oil preferably is selected from polyolefins, esters, polyesters, high VI isoparaffins, and mixtures thereof, with polyalphaolefins being particularly preferred. The polyalphaolefins preferably comprise $C_8$ to $C_{12}$ monoalphaolefin building blocks.

The thickener preferably comprises about 5 to about 30 wt.% of a lithium, calcium, aluminum and/or barium soap of a fatty acid, such as stearic acid or 12-hydroxystearic acid or the complex calcium, lithium, barium and/or aluminum soaps/salts of the fatty acids with lower molecular weight mono or dibasic acids, such as azelaic or benzoic acid, or a modified clay thickener. Particularly preferred are lithium, barium, calcium, or aluminum simple or complex soaps and mixtures thereof, with lithium soaps being particularly preferred. The lithium-containing thickener preferably comprises a complex lithium soap/salt. Particularly preferred are lithium soaps/salts formed by the in-situ saponification reaction of 12-hydroxystearic acid and/or azelaic acid.

The grease of the present invention is of particular utility where the ambient temperature ranges over at least 50° C.

DETAILED DESCRIPTION OF THE INVENTION

The present invention is directed at a grease composition having particular ability where the ambient temperature varies over a relatively wide range. The grease composition comprises:

A. an oil component having a major amount of a synthetic fluid having a viscosity of at least 50 cSt at 40° C. and a minor amount of a mineral oil having a pour point below about −20° C.; and, B. a thickener.

The viscosity of the mineral oil preferably is less than the viscosity of the synthetic fluid over the temperature range for which the use is contemplated.

In order to combine the highest possible oil viscosity at ambient summer temperatures for satisfactory lubrication with the lowest possible oil viscosity at ambient winter temperatures to ensure satisfactory dispensing, the base oil or combination of base oils used in the grease should have a relatively high viscosity index and a relatively low pour point. As shown by the data in Table 1 and Table 2, the best combinations of high VI and low pour point are obtained from blends of low viscosity, low pour point oils (naphthenic or synthetic) with relatively high viscosity, high VI synthetic fluids.

A suitable grease should have an oil component VI above about 100 and preferably above about 125. Similarly, the oil pour point should be below about −20° C., preferably below about −30° C. and more preferably below about −40° C.

The composition of each of the grease components is set forth in detail below:

A. Synthetic Fluid

The viscosity index of the synthetic fluid should be relatively high. The synthetic fluid may comprise polyalphaolefins, diesters, polyolesters, complex esters, the high VI isoparaffins produced by hydrocracking or hydroisomerization of waxes, and mixtures thereof. Of these, the polyalphaolefins are particularly preferred, since many are commercially available. The preferred hydrogenated polyalphaolefins have viscosities in the range of 8–150 cSt at 100° C., VI's of at least 125, and pour points below about −20° C., preferably below about −30° C. and more preferably below about −40° C. Such polyalphaolefins may be produced from linear alpha olefins containing about 8–12 carbon atoms by an oligomerization process which produces dimers, trimers, tetramers, pentamers, etc. of these olefins. In general, the viscosity of the polyalphaolefins increases with the molecular weight of the oligomer, while the mono olefin carbon number, linearity, and position of unsaturation, determine the VI and pour point of the polyalphaolefin oligomer. Generally, the higher the carbon number of the mono olefin, the higher the VI and the higher the pour point of the oligomer. Nonlinear mono olefins are not preferred, since they tend to produce lower VI oligomers. Internal olefin monomers also produce more branched polyolefin structures which exhibit lower VI's and generally lower pour points. A satisfactory combination of pour point and VI has been obtained by polymerizing $C_{10}$ linear alpha olefins monomers and hydrogenating the resulting polymer.

B. Mineral Oil

The mineral oil of the present invention is derived from crude and preferably has a pour point below −20° C., more preferably below −30° C. and most preferably below −40° C. The mineral oil may comprise any hydrocarbon stream having the desired pour point. Naphthenic oils, such as transformer oil and/or spindle oil and mixtures thereof, are particularly preferred. When oils are utilized having pour points above −20° C., it has been found that the grease does not have the requisite low temperature dispensibility properties.

C. Thickener

The thickener of the present invention preferably comprises between about 5 and about 30 wt.% of the grease, preferably between about 5 and about 20 wt.% of the grease composition. The thickener preferably comprises a simple calcium, lithium, aluminum and/or barium soap of a fatty acid, such as stearic acid or 12-hydroxystearic acid or the complex calcium, lithium, barium and/or aluminum soaps/salts of the fatty acids with lower molecular weight mono or azelaic or benzoic acid, or a modified clay thickener. Particularly preferred are lithium, barium, calcium, or aluminum simple or complex soaps and mixtures thereof, with lithium soaps being particularly preferred. The lithium containing thickener preferably comprises a complex lithium soap/salt. Particularly preferred are lithium soap/salts formed by the in-situ saponification reaction of 12-hydroxystearic acid and/or azelaic acid.

A series of tests were conducted to demonstrate the utility of the present invention in producing a grease having the desired viscosities and pour point properties. The greases indicated below had a thickener system comprising approximately:

8.5 wt.% 12-hydroxystearic acid
3.0 wt.% azelaic acid; and
2.5 wt.% lithium hydroxide monohydrate.

The greases also had an additive package comprising an extreme pressure additive, an anti-wear additive, an anti-rust additive and an antioxidant.

The individual additives comprising the additive package may be conventional. Among the preferred extreme pressure additives are lead naphthenate, lead dialkyldithiocarbamate, antimony dialkyldithiocarbamate, etc.

Among the preferred anti-wear additives are zinc dialkyldithiophosphates, zinc dialkyldithiocarbamates, etc.

Among the preferred anti-oxidant additives are PANA, alkyl-substituted aromatic amines, etc.

Among the preferred anti-rust additives are various sulphonates based on sodium, barium, etc.

To this additive package may be added other additives required for the specific end use, such as seal swell agents, tackiness additives, dyes, etc.

In the comparative examples and examples below, an effort was made to maintain the thickener content within the range of about 12–14 wt.%. There were minor variations in the thickener content because different oils were used. Higher thickener content would increase the grease cost considerably and could adversely affect pumpability.

TABLE I

CHARACTERISTICS OF OILS CONSIDERED FOR IMPROVED GREASE COMPOSITION

| Oil | Type | Viscosity, cSt 40° C. | Viscosity, cSt 100° C. | VI | Pour °C. |
|---|---|---|---|---|---|
| MCT 5 | Pffn, Ex, Dw, Hy | 17.41 | 3.652 | 87 | −18 |
| MCT 30 | Pffn, Ex, Dw, Hy | 98.76 | 10.80 | 92 | −9 |
| 2507 Bright Stock | Pffn, Ex, Dw, Hy | 448.8 | 31.18 | 100 | −6 |
| CW O | Naph, Ex, Hy | 8.051 | 2.193 | 65 | −42 |
| FLEXON 765 | Naph, Ex, Hy | 91.99 | 9.269 | 68 | −6 |
| CORAY 1000 | Naph, Da, Dh, Hy | 950.1 | 39.44 | 70 | −9 |
| PAO 4 cSt | Synthetic polyolefin | 16.74 | 3.853 | 124 | <−60 (TYP) |
| SHF 401 | Synthetic polyolefin | 408.5 | 40.47 | 149 | −33 |

Pffn — derived from paraffinic crude
Naph — derived from naphthenic crude
Ex — solvent extracted
Da — deasphalted
Dw — dewaxed
Dh — dehazyed
Hy — hydrofined

TABLE II

CHARACTERISTICS OF OIL BLENDS FOR NOMINAL VISCOSITY OF 100 cSt @ 40° C.

| Oil | Composition Weight % A | B | C | D | E | F | G | H | I |
|---|---|---|---|---|---|---|---|---|---|
| MCT 5 | — | — | — | 40.0 | — | — | — | — | — |
| MCT 30 | 100.0 | — | — | — | — | — | — | — | — |
| 2507 Bright Stock | — | 69.0 | 64.0 | — | — | — | — | — | — |
| CW O | — | 31.0 | — | — | 31.0 | — | — | — | 36.0 |
| FLEXON 765 | — | — | — | — | — | — | 95.5 | — | — |
| CORAY 1000 | — | — | — | — | — | — | 4.5 | 59.0 | 64.0 |
| PAO 4 cSt | — | — | 36.0 | — | — | 38.0 | — | 41.0 | — |
| SHF 401 | — | — | — | 60.0 | 69.0 | 62.0 | — | — | — |
| Viscosity | | | | | | | | | |
| V40° C., cSt | 98.76 | 101.5 | 103.5 | 104.2 | 104.0 | 103.7 | 100.5 | 101.5 | 101.8 |
| V100° C., cSt | 10.80 | 11.96 | 12.74 | 14.95 | 15.39 | 15.08 | 9.911 | 11.49 | 10.70 |
| VI | 92 | 108 | 118 | 150 | 156 | 152 | 71 | 100 | 86 |
| Pour, °C. | −9 | −15 | −15 | −18 | −48 | −54 | −9 | −24 | −21 |

TABLE III

CHARACTERISTICS OF GREASES DERIVED FROM DIFFERENT OIL TYPES

| Grease | Composition, Wt. % Thickener | Oil | Additives | PEN (60 x) mm/10 | Apparent Viscosity Poise @ −40° C., 20 sec$^{-1}$ |
|---|---|---|---|---|---|
| AA | — | — | — | — | — |
| BB | 12.14 | 82.43 | 5.43 | 321 | 27,000 |
| CC | 13.38 | 81.22 | 5.40 | 317 | 22,500 |
| DD | 12.71 | 82.03 | 5.26 | 308 | 18,000 |
| EE | 13.96 | 80.62 | 5.42 | 313 | 7,200 |
| FF | 19.38 | 75.27 | 5.35 | 308 | 9,000 |
| GG | — | — | — | — | — |
| HH | 17.36 | 77.37 | 5.27 | 305 | 42,000 |
| II | — | — | — | — | — |

As shown in Table III, the Grease EE and Grease FF exhibited good low temperature dispensibility, as evidenced by the low apparent viscosity at −40° C. As indicated in Table II, these greases also contained a high VI oil blend with a high viscosity at the upper operating temperature of 35° to 45° C. Grease EE would be preferred because of its significantly lower cost and lower thickener content.

While the grease of the present invention set forth in Tables I and II was formulated to meet NLGI #1 ½ grade specifications, the grease also could be formulated to meet other NLGI penetration ranges by adjusting the thickener content, and the relative amounts of mineral oil and synthetic oil.

What is claimed is:

1. A grease composition comprising:

A. an oil component having a VI above about 100 and a pour point below about −20° C. which contains between about 30 and 90 wt.% of a synthetic fluid selected from the group consisting of polyalphaolefins containing oligomers of $C_8$–$C_{12}$ linear alphaolefins, diesters, polyolesters, high VI isoparaffins and mixtures thereof, said synthetic fluid having a viscosity of at least 50 cSt at 40° C. and from about 70 to about 10 wt.% of a mineral oil having a pour point below about −20° C.; and B. a thickener.

2. The grease composition of claim 1 wherein the synthetic fluid comprises a polyalphaolefin having a viscosity in the range of 8–150 cSt at 100° C.

3. The grease composition of claim 1 wherein the mineral oil has a pour point below −30° C.

4. The grease composition of claim 3 wherein the mineral oil has a pour point below −40° C.

5. The grease composition of claim 1 wherein the thickener contains a metal selected from the group consisting of lithium, calcium, barium, aluminum and mixtures thereof.

6. The grease composition of claim 5 wherein the thickener comprises a lithium complex soap.

7. The grease composition of claim 1 wherein the synthetic fluid content ranges between about 40 and 80 wt.% of the oil component.

8. The grease composition of claim 1 wherein the mineral oil content ranges from 60 to 20 wt.% of the oil component.

9. The grease composition of claim 1 wherein the thickener content ranges between about 5 and about 30 wt.% of the grease composition.

10. The composition of claim 1 wherein the VI of said oil component is at least 125.

11. The grease composition of claim 1 wherein the synthetic fluid content is a major amount of the oil component and the mineral oil content is a minor amount of the oil component.

12. A grease composition comprising:

A. an oil component having a VI above about 100 and a pour point below about −20° C. which contains from about 30 to about 90 wt.% of a polyalphaolefin comprising oligomers of $C_8$–$C_{12}$ linear alphaolefins having a viscosity in the range of 8–150 cSt at 100° C., and from about 70 to about 10 wt.% of a mineral oil having a pour point below about −20° C.; and B. about 5 to about 30 wt.% of a lithium-containing thickener.

13. The composition of claim 12 wherein the VI of said oil component is at least 125.

14. The grease composition of claim 12 wherein the polyalphaolefin content ranges between about 40 and 80 wt.% of the oil component.

15. The grease composition of claim 12 wherein the mineral oil content ranges from 60 to 20 wt.% of the oil component.

16. The grease composition of claim 12 wherein the polyalphaolefin content is a major amount of the oil component and the mineral oil content is a minor amount of the oil component.

* * * * *